US006450826B1

(12) United States Patent
Howell et al.

(10) Patent No.: US 6,450,826 B1
(45) Date of Patent: Sep. 17, 2002

(54) CONTACT OF ELECTRICAL CONNECTOR

(75) Inventors: David G. Howell, Gilbert, AZ (US); Fang-Chu Liao, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/994,422

(22) Filed: Nov. 26, 2001

(51) Int. Cl.[7] ..... H01R 4/50
(52) U.S. Cl. ..... 439/342; 439/884
(58) Field of Search ..... 439/342, 70, 71, 439/884

(56) References Cited

U.S. PATENT DOCUMENTS 4,498,725 A * 2/1985 Bright et al. ..... 439/342
4,997,385 A * 3/1991 Casagrande ..... 439/259
5,044,973 A * 9/1991 Noda et al. ..... 439/264
5,092,789 A * 3/1992 Sinclair ..... 439/259
5,299,950 A * 4/1994 Kaneko ..... 439/265
5,443,591 A * 8/1995 Tsai ..... 439/342
5,569,045 A * 10/1996 Hsu ..... 439/259
5,762,511 A * 6/1998 Scheitz et al. ..... 439/259
5,797,774 A * 8/1998 Kaneko ..... 439/342

* cited by examiner

*Primary Examiner*—Tulsidas Patel
(74) *Attorney, Agent, or Firm*—Wei Te Chung

(57) ABSTRACT

An electrical connector includes an insulative housing defining a number of channels each receiving and retaining a conductive contact. The contact includes a base section having upper and lower edges and opposite side edges connecting the upper and lower edges. Barbs are formed on side edges of the base section to interferentially retain the contact in the channel. Two support sections that are made slim and thus relatively flexible extend from the upper edge of the base section. The support sections are spaced from each other and forms a common plane with the base section. An arm that is relatively rigid extends from each support section in a direction substantially normal to the common plane. The arms are arranged to face each other. The arms are spaced from the upper edge of the base section different distances whereby the arms are staggered with respect to each other. The staggered arms helps saving space and accommodating improperly positioned pin to be engaged by the arms. A soldering section extends from the lower edge of the base section to be soldered to an external device.

19 Claims, 3 Drawing Sheets

CONTACT OF ELECTRICAL CONNECTOR

FIELD OF THE INVENTION

The present invention generally relates to a Zero Insertion Force (ZIF) socket type electrical connector, and in particular to a contact structure of a ZIF socket connector.

BACKGROUND OF THE INVENTION

Zero Insertion Force (ZIF) socket type electrical connectors have been widely used in connecting an electronic device, such as a central processing unit (CPU) package, to for example a printed circuit board. A socket connector generally comprises an insulative housing or base in which a number of bores or channels is defined, each receiving and retaining a conductive contact. Each bore forms an interior space that is large enough so that the contact that is received in the bore occupies only a fraction of the space . An extra free space is thus left in the bore for receiving a corresponding pin of the electronic device therein with substantially no resistance. Once the pin is placed into the extra free space, the electronic device is moved with respect to the housing, driving the pin into engagement with a resilient arm of the contact. The arm is then deflected, ensuring a stable engagement between the pin and the arm.

Some of the conventional contacts designed for such purposes have a single arm. Examples are U.S. Pat. Nos. 5,052,101 and 5,489,218. A disadvantage associated with the single-armed contact is that the pin is subject to a moment caused by the resilient force of the single arm. In addition, due to small size of the contacts and the high density of contacts arranged in the housing, the pins of the electronic device must be perfectly aligned to the corresponding contacts before the are pins are driven to engage the arms of the contacts. This is in general very difficult to accomplish.

The others of the conventional contacts take a design of double arms wherein two resilient arms extend from opposite edges of a substantially rigid base section. The arms are opposite to each other and spaced a distance generally smaller than a diameter of the corresponding pin of the electronic device. When the pin is driven into the space between the arms, the arms are deflected away from each other to accommodate the pin. Since two arms are deflected at the same time a large driving force than that is needed in a comparable single-armed socket is required.

In addition, to provide sufficient compliance of the arm with the pin when the pin is brought into contact with the arm, the arm is made to have a greater length. This reduces the extra free space inside the bore, making the insertion of the pin into the bore difficult.

Further, the conventional double arm design requires the two arms extend away from a contact in opposite direction. When the contacts are stamped from a blank of metal sheet, the contact occupies a large space on the metal sheet. This causes certain disadvantage in manufacturing the contacts and increases costs.

It is thus desirable to provide a contact structure of an electrical connector to alleviate or even eliminate the above-discussed problems.

SUMMARY OF THE INVENTION

Accordingly, an object of the present invention is to provide a contact of an electrical connector comprising two arms that are allowed to both deflect and rotate for ensuring stable engagement with a pin of the electronic device inserted Another object of the present invention is to provide a contact of an electrical connector having arms of short dimension in order to provide a maximum ZIF space.

Another object of the present invention is to provide a contact of an electrical connector having a design allowing a number of contacts to be compactly arranged on a blank of metal sheet.

A further object of the present invention is to provide a contact of an electrical connector having two arms arranged in a staggered fashion for accommodating an improperly positioned pin of an external electrical device.

To achieve the above objects, in accordance with the present invention, there is provided a contact of an electrical connector comprising a base section having upper and lower edges and opposite side edges connecting the upper and lower edges. Barbs are formed on side edges of the base section to interferentially retain the contact in a channel defined in a housing of the electrical connector. Two support sections that are made slim and thus relatively flexible extend from the upper edge of the base section. The support sections are spaced from each other and forms a common plane with the base section. An arm that is relatively rigid extends from each support section in a direction substantially normal to the common plane. The arms are arranged to face each other. The arms are spaced from the upper edge of the base section different distances whereby the arms are staggered with respect to each other. The staggered arms helps saving space and accommodating improperly positioned pin to be engaged by the arms. A soldering section extends from the lower edge of the base section to be soldered to an external device.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
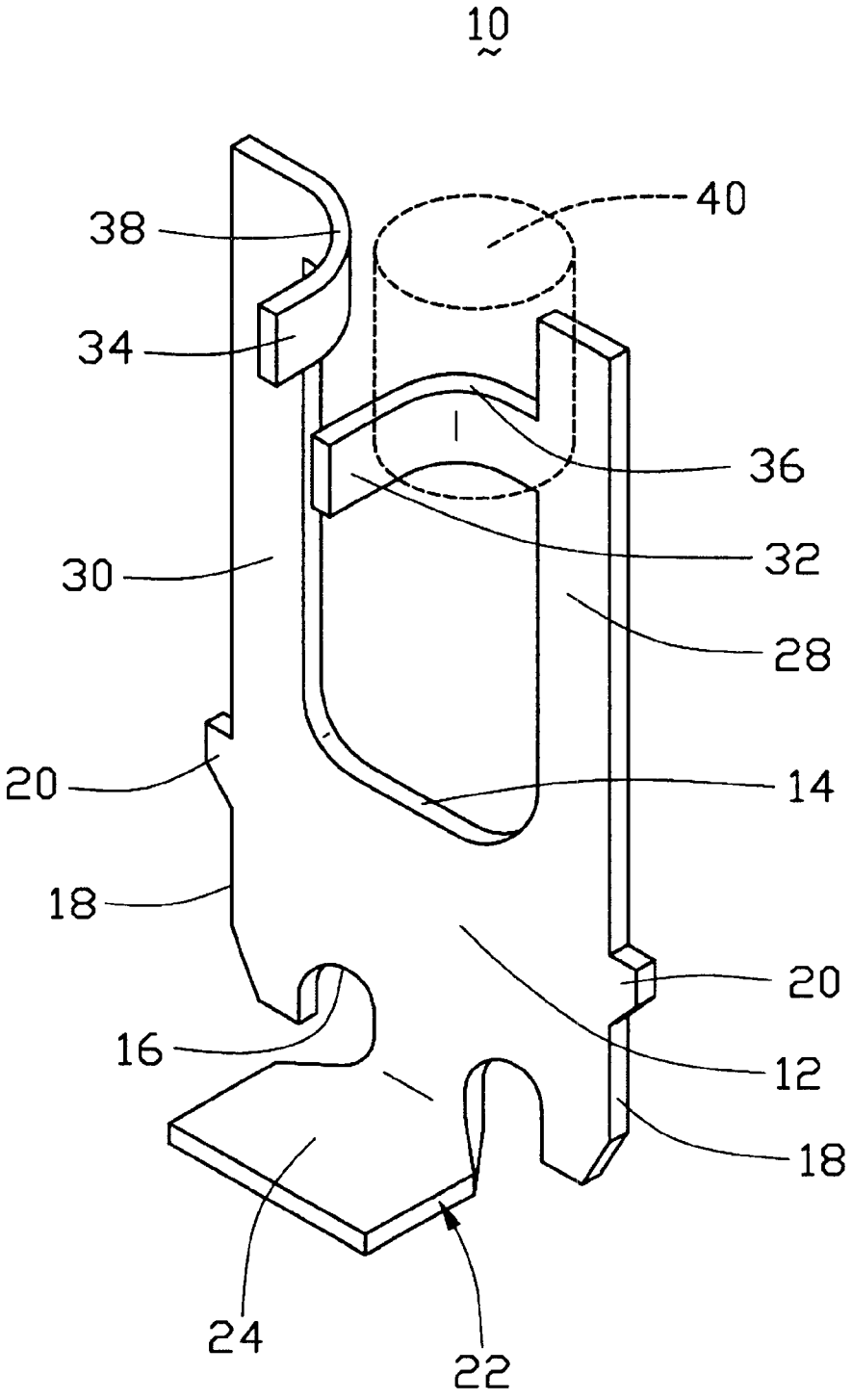
FIG. 1 is a perspective view showing a contact constructed in accordance with the present invention.
Figure 2:
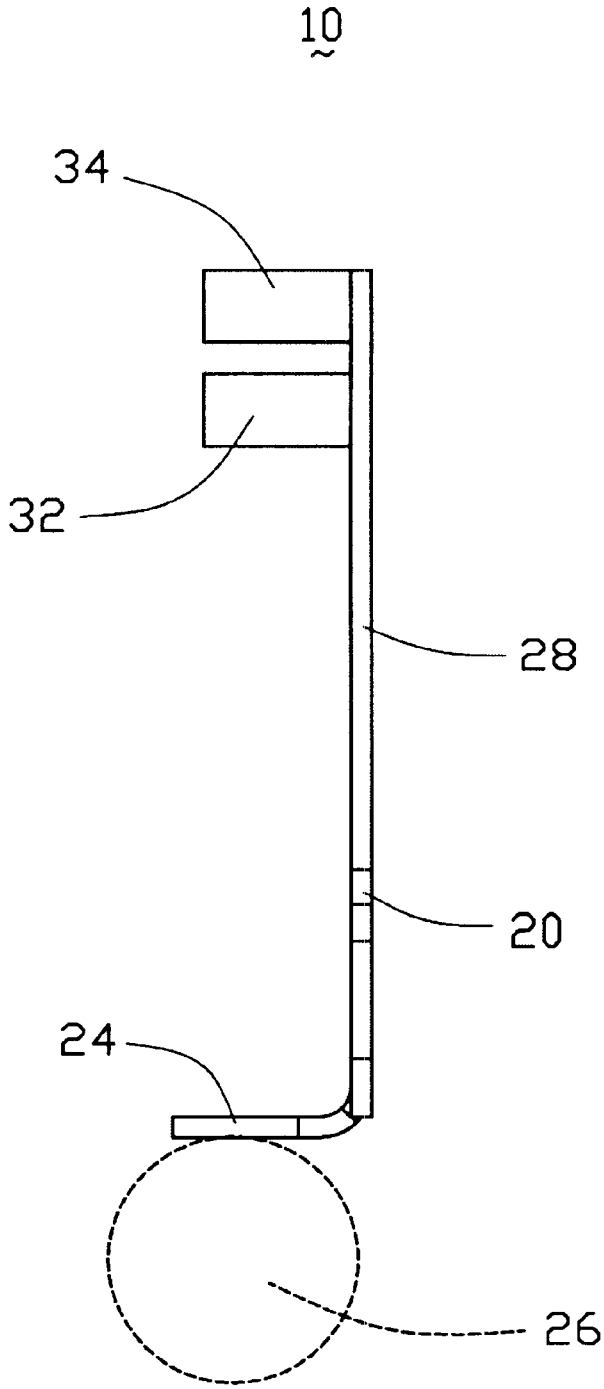
FIG. 2 is a side elevational view of the contact of the present invention.
Figure 3:
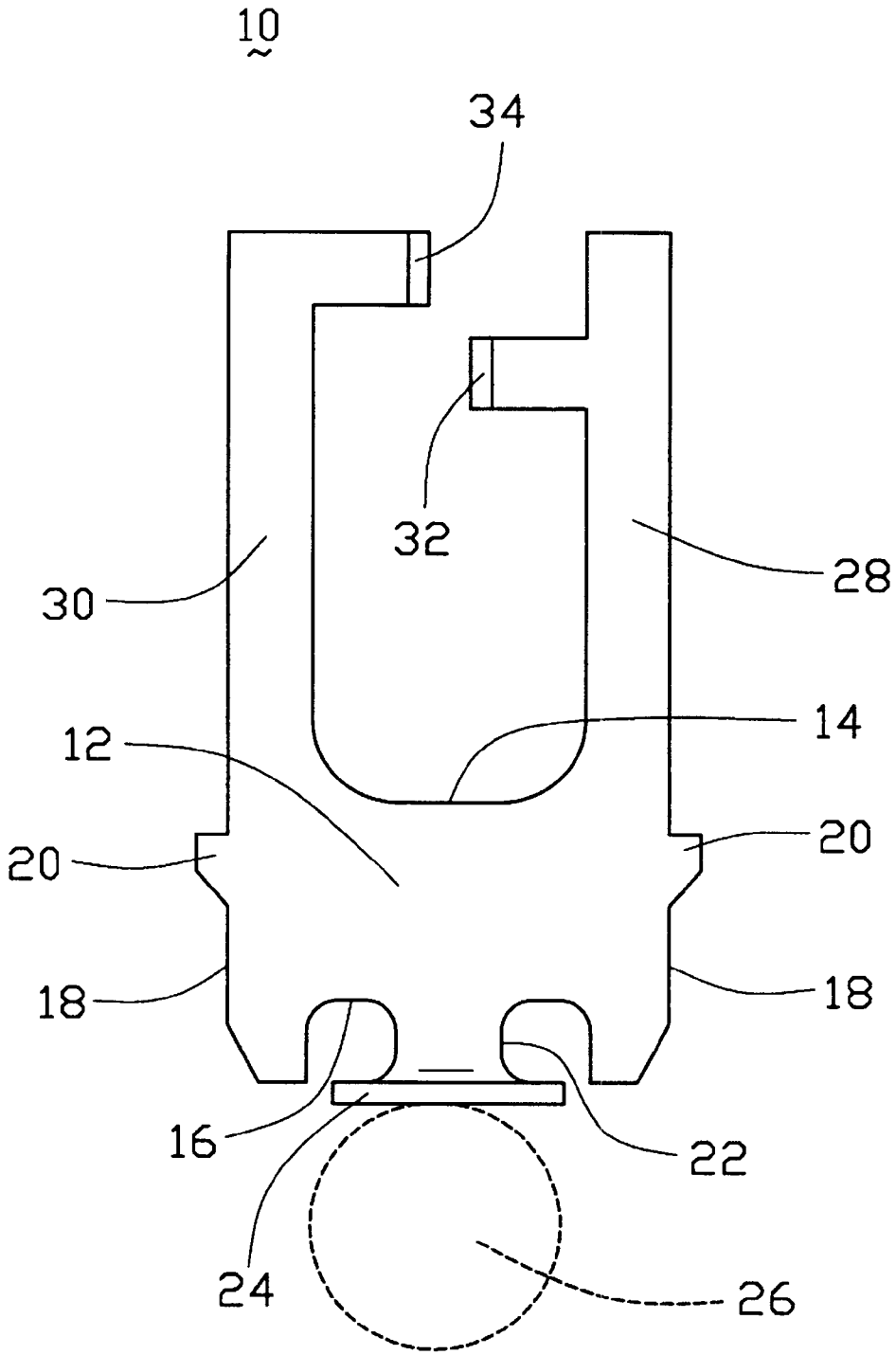
FIG. 3 is a front view of the contact of the present invention.

An electrical connector generally comprises an insulative housing defining at least one channel for receiving and retaining a conductive contact. The contact is usually designed to meet certain requirements of mechanical and electrical performances. FIGS. 1–3 of the attached drawings show a contact constructed in accordance with the present invention. Such a contact is in general adapted in a socket type connector. One potential use of such a socket connector is, with the connector mounted on a printed circuit board, to connect an electronic device, such as a central processing unit (CPU) package, to the circuit board. The following description of the contact of the present invention is illustrative only, not to restrict the use and application of the contact. In addition, the contact of the present invention can also be adapted in connectors of other types or devices of different purposes.

With reference to FIGS. 1–3, a contact constructed in accordance with the present invention, generally designated with reference numeral 10, comprises a base section 12 having upper and lower edges 14, 16 and opposite side edges 18 connecting the upper and lower edges 12, 14. Retention means, such as barb 20, is formed on each side edge 18 of the base section 12. The barbs 20 mechanically interferes with side walls of a channel defined in an insulative housing (not shown) in which the contact 10 is retained. The interferential engagement between the barbs 20 and the walls securely retains the contact 10 in position inside the channel.

A lower extension 22 is formed on the lower edge 16 of the base section 12. A free end of the lower extension 22 forms a soldering section 24 which is the embodiment illustrated comprises a platform extending in a direction substantially for carrying a solder ball 26 (shown in dashed line in FIGS. 2 and 3) or a mass of soldering material. The contact 10 is so arranged in the corresponding channel of the housing that the solder ball 26 at least partially extend beyond the housing for being soldered to a conductive pattern formed on the printed circuit board.

Alternatively but not shown in the drawings, the soldering section of the lower extension 22 may be formed as an elongated pin extending in a direction substantially parallel to the base section 12 for being received in a hole defined in a printed circuit board. Soldering may then be employed to fix the pin to the printed circuit board, forming electrical connection therebetween.

First and second support sections 28, 30 extend from the upper edge 14 of the base section 12. In the embodiment illustrated, the support sections 28, 30 are spaced from each other and substantially align with the corresponding side edges 18 of the base section 12. The support sections 28, 30 have a first dimension (length) in the direction parallel to the side edge 18 of the base section 12 and a second dimension (width) in the direction toward each other whereby the first and second dimensions form a plane substantially aligned with the base section 12.

Each support section 28, 30 forms an arm 32, 34 extending in a direction substantially perpendicular to the plane of the support sections 28, 30 and the base section 12. In the embodiment illustrated, the contact 10 is made by stamping a sheet of metal and thus, the arms 32, 34 originally extend from the support sections 28, 30 in a direction substantially parallel to the plane of the support sections 28, 30, preferably toward each other, and are then bent 90 degrees to be perpendicular to the plane. An arc portion 36, 38 is thus formed between the arms 32, 34 and the support sections 28, 30, serving as lead-in for a pin 40 of for example a central processing unit (CPU) package. The arms 32, 34 are spaced from each other a distance that is smaller than a diameter of the CPU pin 40 whereby a physical engagement can occur between the pin 40 and the arms 32, 34 when the CPU pin 40 is driven against the arms 32, 34.

The arms 32, 34 are arranged in a staggered fashion forming a non-symmetric configuration. In other words, the distance between the first arm 32 and the upper edge 14 of the base section 12 is different from (greater than, in this case) that between the second arm 34 and the upper edge 14 of the base section 12. Such a non-symmetric configuration gives the contact 10 flexibility to accommodate CPU pin 40 that is not properly positioned or having large manufacturing tolerance.

In the embodiment illustrated, the length of the support sections 28, 30 is much greater than the width of the support sections 28, 30 so that the support sections 28, 30 are readily deflected/deformed. In this respect, the barbs 20 are located as far from the arms 32, 34 as possible. Compared to the "slim" and "soft" support sections 28, 30, the arms 32, 34 are much shorter, making them relatively rigid. Such short arms reduce the amount of space occupied by the contact 10 inside the channel of the housing, leaving a large space for receiving the CPU pin 40 in a zero-insertion-force (ZIF) fashion.

Due to the rigid arms 32, 34 and the soft support sections 28, 30, when the CPU pin 40 is brought into engagement with the arms 32, 34, the support sections 28, 30 are twisted and deflected, and thus allowing the arms 32, 34 to rotate for accommodating the CPU pin 40. The soft support sections 28, 30 ensure proper engagement between the arms 32, 34 and the CPU pin 40. Further, the reaction force of the deformed support sections 28, 30 ensures a stable and secure engagement between the arms 32, 34 and the CPU pin 40.

In addition, since the arms 32, 34 are arranged in a staggered fashion, the arms 32, 34 May overlap each other before they are bent to the final shape shown in the drawings. The overall width of the contact 10 before the arms 32, 34 are bent is reduced. A number of contacts 10 can be compactly arranged on a sheet of metal from which the contacts 10 are stamped. The manufacturing process is easier and costs are reduced.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A contact adapted to be retained in a channel defined in a housing, the contact comprising:

a base section adapted to be retained in the channel of the housing;

two support sections spaced from each other and extending from a first edge of the base section, the support sections and the base section forming a plane; and an arm extending from each support section in a direction substantially normal to said plane, the arms being spaced from the first edge of the base section different distances whereby the arms are staggered with respect to each other.

2. The contact as claimed in claim 1, wherein each support section has an inner edge facing each other, an arc portion extending from the inner edge of each support section and connecting the corresponding arm to the support section.

3. The contact as claimed in claim 2, wherein the contact is formed by stamping a sheet of metal, the arms originally extending from the inner edges of the support sections toward each other and then bent 90 degree for forming the arc portions.

4. The contact as claimed in claim 3, wherein the arms and the support sections are dimensioned so that the arms have a rigidity greater than that of the support sections.

5. The contact as claimed in claim 1, wherein a retention device is formed on the base section for retaining the contact in the channel.

6. The contact as claimed in claim 5, wherein the retention device comprises a barb formed on each of opposite side edges of the base section.

7. The contact as claimed in claim 6, wherein the barbs are located far from the arms.

8. The contact as claimed in claim 2, wherein the base section has a second edge, opposite to the first edge, with a soldering section extending from the second edge, the soldering section being adapted to be soldered to an external electrical device.

9. The contact as claimed in claim 8, wherein the soldering section forms a platform for carrying a mass of soldering material.

10. A contact adapted to be retained in a channel defined in a housing, the contact comprising:

a base section having upper and lower edges and opposite side edges connecting the upper and lower edges, the base section being retained in the channel of the housing;

two support sections spaced from each other and extending from the upper edge of the base section, the support sections and the blase section forming a plane;

an arm extending from each support section in a direction substantially normal to said plane, the arms being spaced from the upper edge of the base section different distances whereby the arms are staggered with respect to each other; and a soldering section extending from the lower edge of the base section and adapted to be soldered to an external device.

11. The contact as claimed in claim 10, wherein each support section has an inner edge facing each other, an arc portion extending from the inner edge of each support section and connecting the corresponding arm to the support section.

12. The contact as claimed in claim 11, wherein the contact is formed by stamping a sheet of metal, the arms originally extending from the inner edges of the support sections toward each other and then bent 90 degree for forming the arc portions.

13. The contact as claimed in claim 12, wherein the arms and the support sections are dimensioned so that the arms have a rigidity greater than that of the support sections.

14. The contact as claimed in claim 10, wherein a retention device is formed on the base section for retaining the contact in the channel.

15. The contact as claimed in claim 14, wherein the retention device comprises a barb formed on each of the side edges of the base section.

16. The contact as claimed in claim 15, wherein the barbs are located far from the arms.

17. The contact as claimed in claim 10, wherein the soldering section forms a platform for carrying a mass of soldering material.

18. An electrical assembly comprising:

a socket contact including:

a vertical planar base section;

a solder section positioned around a bottom portion of the base section;

a pair of support sections upwardly extending from the base section and spaced from each other;

a pair of arms respectively extending from top portions of the support sections in a direction perpendicularly away from said planar base section;

an arc portion formed at a joint between each of said pair of arms and the corresponding support section; and a round pin coupled to said socket contact, along said direction, from one side thereof opposite to said pair of arms; wherein said round pin first engages the arc portions and finally sandwiched between said pair of arms in position.

19. The assembly as claimed in claim 18, wherein said pair of arms are offset from each other in a vertical direction, perpendicular to said direction, along which the support sections extend.

* * * * *